US008388366B2

(12) United States Patent
Yang

(10) Patent No.: US 8,388,366 B2
(45) Date of Patent: Mar. 5, 2013

(54) PULL-OUT STRUCTURE FOR CONNECTOR

(75) Inventor: Fenny Yang, New Taipei (TW)

(73) Assignee: All Best Electronics Co., Ltd. (TW)

( * ) Notice: Subject to any disclaimer, the term of this patent is extended or adjusted under 35 U.S.C. 154(b) by 20 days.

(21) Appl. No.: 13/116,289

(22) Filed: May 26, 2011

(65) Prior Publication Data

US 2012/0302078 A1 Nov. 29, 2012

(51) Int. Cl.
*H01R 13/627* (2006.01)

(52) U.S. Cl. ..... 439/357

(58) Field of Classification Search ..... 439/357, 439/352, 372

See application file for complete search history.

(56) References Cited

U.S. PATENT DOCUMENTS

| | | | | |
|---|---|---|---|---|
| 5,797,768 | A * | 8/1998 | Francaviglia | 439/567 |
| 6,447,170 | B1 * | 9/2002 | Takahashi et al. | 385/53 |
| 6,589,066 | B1 * | 7/2003 | Wu | 439/352 |
| 6,648,665 | B1 * | 11/2003 | Wu | 439/352 |
| 6,733,323 | B2 * | 5/2004 | Tso-Chin | 439/484 |
| 6,872,010 | B1 * | 3/2005 | Bianchini | 385/92 |
| 6,883,971 | B2 * | 4/2005 | Chiu et al. | 385/53 |
| 6,991,481 | B1 * | 1/2006 | Guan et al. | 439/160 |
| 7,008,253 | B2 * | 3/2006 | Szczesny | 439/352 |
| 7,134,914 | B1 * | 11/2006 | Wu | 439/607.41 |
| 7,445,485 | B1 * | 11/2008 | Wu | 439/352 |
| 7,473,124 | B1 * | 1/2009 | Briant et al. | 439/352 |
| 7,513,693 | B2 * | 4/2009 | Wang | 385/56 |
| 7,534,125 | B1 * | 5/2009 | Schroll | 439/352 |
| 7,540,755 | B1 * | 6/2009 | Wu | 439/352 |
| 7,666,023 | B2 * | 2/2010 | Wu | 439/352 |
| 7,690,939 | B2 * | 4/2010 | Wu | 439/352 |
| 7,736,171 | B2 * | 6/2010 | Reed et al. | 439/352 |
| 7,798,819 | B2 * | 9/2010 | Kudo et al. | 439/74 |
| 7,841,887 | B2 * | 11/2010 | Zhang et al. | 439/352 |
| 7,901,226 | B2 * | 3/2011 | Kotaka | 439/160 |
| 8,011,950 | B2 * | 9/2011 | McGrath et al. | 439/497 |
| 8,064,207 | B2 * | 11/2011 | Wu | 361/747 |
| 8,226,305 | B2 * | 7/2012 | Thirugnanam et al. | 385/92 |
| 8,231,400 | B2 * | 7/2012 | Phillips et al. | 439/357 |
| 8,238,071 | B2 * | 8/2012 | Weng et al. | 361/220 |
| 2002/0093796 | A1 * | 7/2002 | Medina | 361/728 |
| 2004/0033027 | A1 * | 2/2004 | Pang et al. | 385/53 |
| 2009/0291584 | A1 * | 11/2009 | Wu | 439/345 |
| 2010/0210131 | A1 * | 8/2010 | Reed et al. | 439/352 |

* cited by examiner

*Primary Examiner* — Alexander Gilman
(74) *Attorney, Agent, or Firm* — Schmeiser, Olsen & Watts, LLP

(57) ABSTRACT

A pull-out structure for connector includes a connector and a pull unit. The connector has a locking unit movably arranged thereon and the locking unit includes a retaining section located at a rear end thereof. The pull unit includes an insertion section located at a lower front end thereof, and is engaged with the locking unit by inserting the insertion section into the retaining section of the locking unit. The pull unit and the locking unit have sufficient structural strength. When it is necessary to replace or remove the connector from a shielding cage thereof, a user may directly apply a pulling force on the pull unit to move the locking unit rearward and accordingly easily pull the connector out of the shielding cage without damaging the connector.

6 Claims, 10 Drawing Sheets

A-A

B-B

C-C

PULL-OUT STRUCTURE FOR CONNECTOR

FIELD OF TECHNOLOGY

The present invention relates to a pull-out structure for connector, and more particularly to a pull-out structure that includes a locking unit arranged on a connector and a pull unit engaged with the locking unit. The pull unit and the locking unit have sufficient structural strength, allowing a user to directly apply a pulling force on the pull unit to move the locking unit rearward and accordingly easily pull the connector out of a shielding cage thereof to achieve the purpose of replacing or removing the connector without damaging the same.

BACKGROUND

There are connectors having very small volume, such as SFP (small form-factor pluggable) connectors, X-SFP connectors for 10 GB Ethernet port, and QSFP (quad small form-factor pluggable) connectors. These small connectors, due to their small volume, do not provide sufficient position for a user to hold them and pull them out of a shielding cage thereof to achieve the purpose of replacement. Further, these small connectors tend to become damaged during the process of pulling them out of the shielding cage.

Please refer to FIG. 1. To avoid damaging the small connectors while pulling them out of the shielding cage, a connector 4 having a locking unit 41 and a pull strip 42 is developed. The locking unit 41 includes an operating section 411 and two sliding arms 412 extended from two lateral ends of the operating section 411 and slidably connected to two lateral sides of the connector 4. The pull strip 42 is a pliable strip wound around the operating section 411 of the locking unit 41. When it is necessary to replace the connector 4, a user may pinch the pull strip 42 with thumb and index finger and apply a backward pulling force on the pull strip 42, so that the operating section 411 connected to the pull strip 42 brings the sliding arms 412 to slide backward and thereby pull the connector 4 out of a shielding cage thereof.

The pull strip 42 is made of a pliable material and therefore has relatively low structural strength and break strength. Thus, the pulling force applied by the user on the pliable pull strip 42 could not be effectively transmitted to the locking unit for driving the same to move backward. Further, the pull strip 42 has smooth surfaces and the user has to apply increased force to produce sufficient friction between the pull strip 42 and the user's fingers for pulling the pull strip 42. Therefore, the connector 4 with the locking unit 41 and the pull strip 42 still has the same drawback as the conventional small connectors and could not be conveniently replaced when necessary.

It is therefore tried by the inventor to develop an improved and structurally strong pull-out structure for connector, with which a connector can be easily pulled out of a shielding cage thereof for the purpose of replacement without becoming damaged.

SUMMARY

A primary object of the present invention is to provide a pull-out structure having a locking unit movably arranged on a connector and a pull unit engaged with the locking unit, so that a user can directly apply a pulling force on the pull unit to move the locking unit rearward and accordingly easily pull the connector out of a shielding cage thereof to achieve the purpose of replacing or removing the connector without damaging the same.

To achieve the above and other objects, the pull-out structure for connector according to the present invention includes a pull unit having an insertion section located at a front end thereof, and a connector having a locking unit movably arranged thereon. The locking unit includes a retaining section located at a rear end thereof, and the insertion section of the pull unit is inserted into the retaining section to thereby engage the pull unit with the locking unit.

According to an embodiment of the present invention, the locking unit further includes a pair of sliding arms slidably connected to two lateral sides of the connector, and a transverse plate extended between the two sliding arms. The retaining section is located on the transverse plate and includes at least two corresponding through holes and two receiving holes, and the two receiving holes are separately located at two lateral outer sides of the two through holes.

According to another embodiment of the present invention, the locking unit further includes a pair of sliding arms slidably connected to two lateral sides of the connector, and a transverse plate extended between the two sliding arms. The retaining section is located on the transverse plate and includes at least two corresponding through holes and two forward notches, and the two forward notches are separately located at two lateral outer sides of the two through holes.

According to a further embodiment of the present invention, the locking unit further includes a retaining plate connected to a bottom of the connector, and two operating arms upward extended from two rear lateral sides of the retaining plate. The retaining section is located on top portions of the two operating arms and includes at least two corresponding through holes and two receiving holes, and the two receiving holes are separately located at two lateral outer sides of the two through holes.

According to a still further embodiment of the present invention, the locking unit further includes a retaining plate connected to a bottom of the connector, and two operating arms upward extended from two rear lateral sides of the retaining plate. The retaining section is located on top portions of the two operating arms and includes at least two corresponding through holes and two sideward notches, and the two sideward notches are separately located at two lateral outer sides of the two through holes.

According to an embodiment of the present invention, the pull unit is in the form of a flat plate, the insertion section is located at a lower front end of the pull unit, and the pull unit further includes an opening formed at a rear end thereof.

According to another embodiment of the present invention, the pull unit is in the form of a flat plate, the insertion section is located at a lower front end of the pull unit, and the pull unit further includes an anti-slip area located on an upper rear end thereof.

According to a further embodiment of the present invention, the pull unit is in the form of a flat plate; and the insertion section is located at a lower front end of the pull unit and includes at least two corresponding locating pins and two hooks separately located at two lateral outer sides of the two locating pins.

According to a still further embodiment of the present invention, the pull unit is in the form of a flat plate; and the insertion section is located at a lower front end of the pull unit and includes at least two corresponding locating pins.

According to a still further embodiment of the present invention, the pull unit is in the form of a flat plate; and the insertion section is located at a lower front end of the pull unit and includes at least two corresponding hooks.

Since the pull unit and the locking unit of the pull-out structure for connector have sufficient structural strength, a user can directly apply a pulling force on the pull unit to move the locking unit rearward and accordingly easily pull the connector out of a shielding cage thereof to achieve the purpose of replacing or removing the connector without damaging the same.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION

Figure 1:
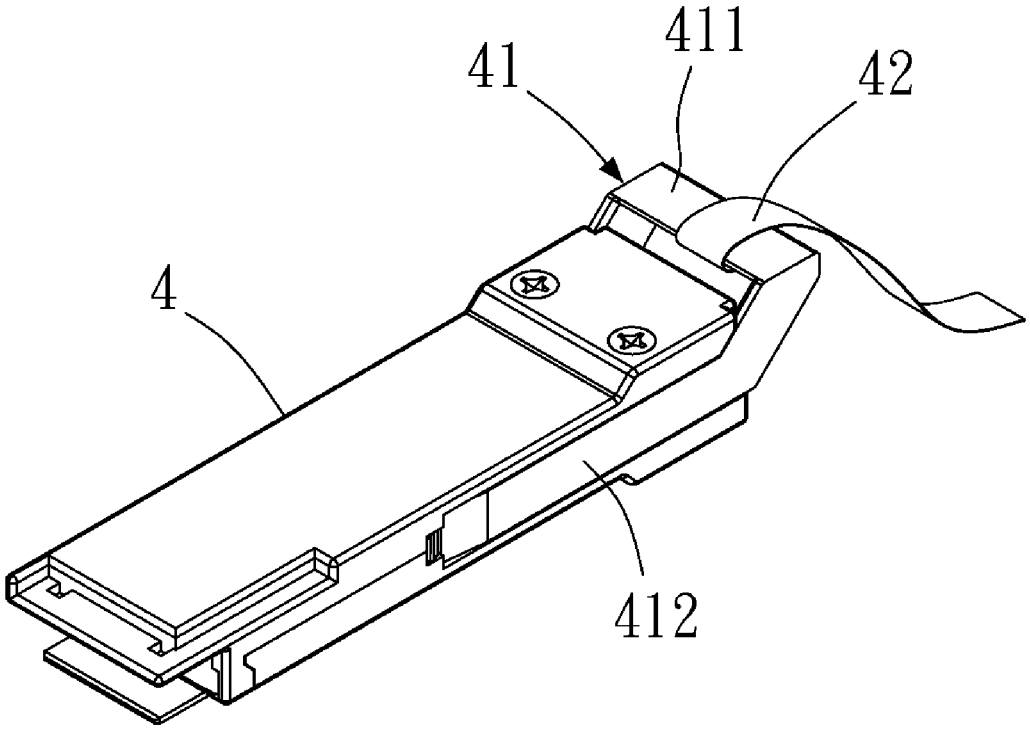
(PRIOR ART) FIG. 1
FIG. 1 is an assembled perspective view showing a conventional pull-out structure for a connector.

The present invention will now be described with some preferred embodiments thereof and with reference to the accompanying drawings. For the purpose of easy to understand, elements that are the same in the preferred embodiments are denoted by the same reference numerals.

Figure 2:
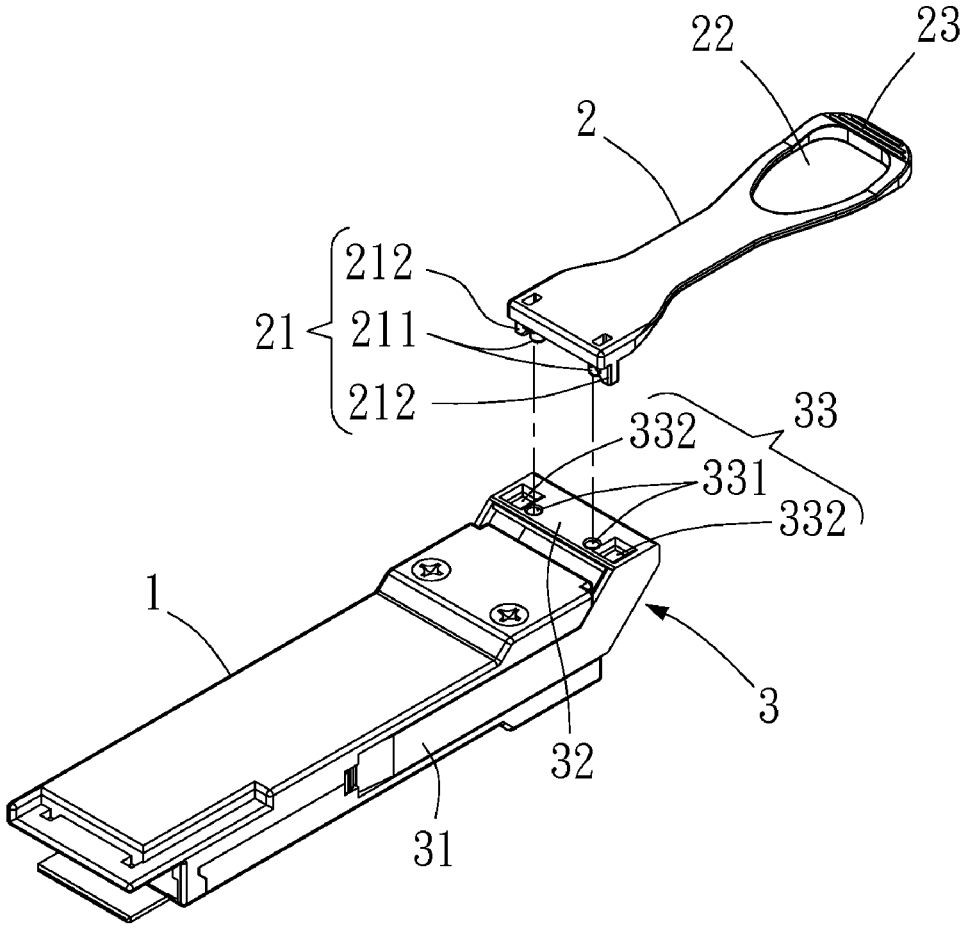
FIG. 2 is an exploded perspective view showing a pull-out structure for connector according to a first embodiment of the present invention.
Figure 3:
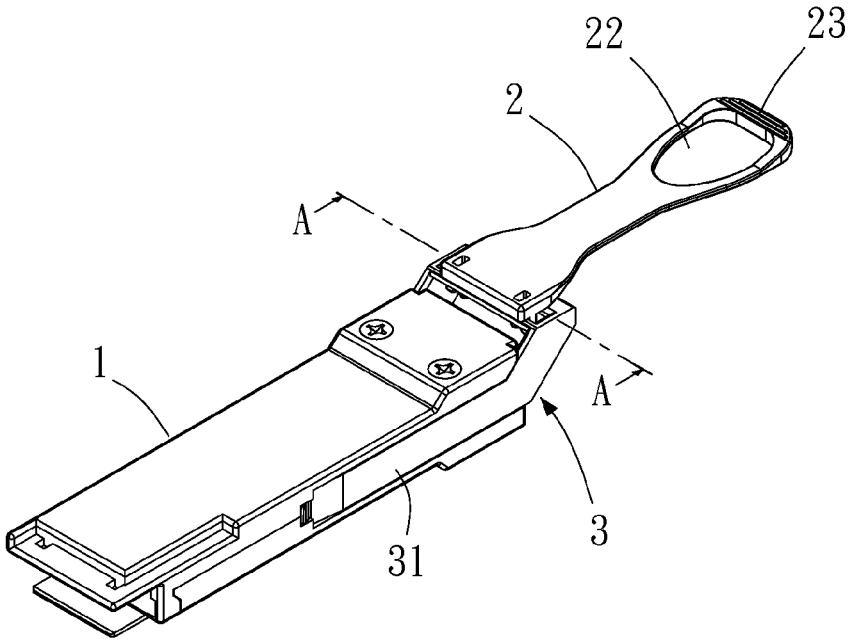
FIG. 3 is an assembled view of FIG. 2.
Figure 4:
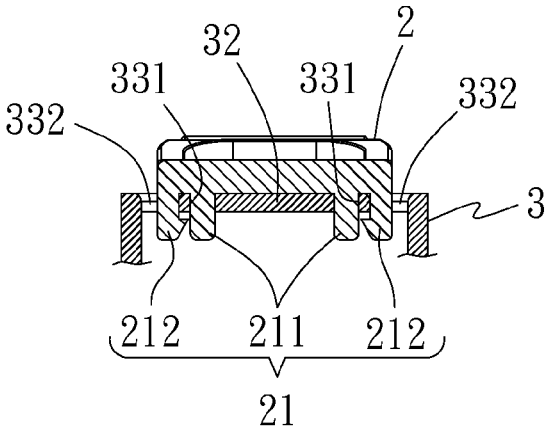
FIG. 4 is a cross-sectional view taken along line A-A of FIG. 3.

Please refer to FIGS. 2 and 3 that are exploded and assembled perspective views, respectively, of a pull-out structure for connector according to a first embodiment of the present invention, and to FIG. 4 that is a cross-sectional view taken along line A-A of FIG. 3. As shown, the pull-out structure for connector in the first embodiment includes a connector 1 and a pull unit 2. The pull unit 2 is provided at a lower front end with an insertion section 21 for correspondingly connecting to the connector 1.

The connector 1 has a locking unit 3 movably arranged on a rear end of the connector 1. The locking unit 3 includes a pair of sliding arms 31 slidably connected to two lateral sides of the connector 1, a transverse plate 32 extended between rear ends of the two sliding arms 31, and a retaining section 33 provided on one edge of the transverse plate 32 facing toward the connector 1. The retaining section 33 includes at least two corresponding through holes 331 and two receiving holes 332. The receiving holes 332 are separately located at two lateral outer sides of the two through holes 331.

The pull unit 2 is engaged with the locking unit 3, and can be in the form of a flat plate. The insertion section 21 provided at the lower front end of the pull unit 2 is configured for correspondingly engaging with the retaining section 33 of the locking unit 3, and includes at least two corresponding locating pins 211 and two hooks 212. The two hooks 212 are separately located at two lateral outer sides of the two locating pins 211. The pull unit 2 is further provided at a rear end with an opening 22. And, an anti-slip area 23 is provided on an upper surface of the rear end of the pull unit 2 behind the opening 22.

To assemble the pull unit 2 to the rear end of the connector 1, first align the insertion section 21 of the pull unit 2 with the retaining section 33 of the locking unit 3, and then insert the locating pins 211 of the insertion section 21 into the through holes 331 of the retaining section 33. At this point, the hooks 212 of the insertion section 21 naturally extend into the receiving holes 332 of the retaining section 33 to hook to a bottom of the transverse plate 32, and the pull unit 2 is firmly connected to the connector 1 via the locking unit 3.

The connector 1 for signal and/or power transmission is inserted in a corresponding shielding cage (not shown). When it is necessary to replace or remove the connector 1 from the shielding cage, a user can extend one finger into the opening 22 or pinch the anti-slip area 23 at the rear end of the pull unit 2 with thumb and index finger, and apply a rearward pulling force on the pull unit 2. At this point, the pull unit 2 engaged with the retaining section 33 will bring the transverse plate 32 and accordingly, the sliding arms 31 of the locking unit 3 to move rearward. The rearward moved sliding arms 31 in turn rearward pull the connector 1 out of the shielding cage. Therefore, with the above arrangements, the pull unit 2 of the pull-out structure for connector according to the first embodiment of the present invention has sufficient structural strength to enable easy replacement or removal of the connector 1 from the shielding cage thereof without damaging the connector 1.

Figure 5:
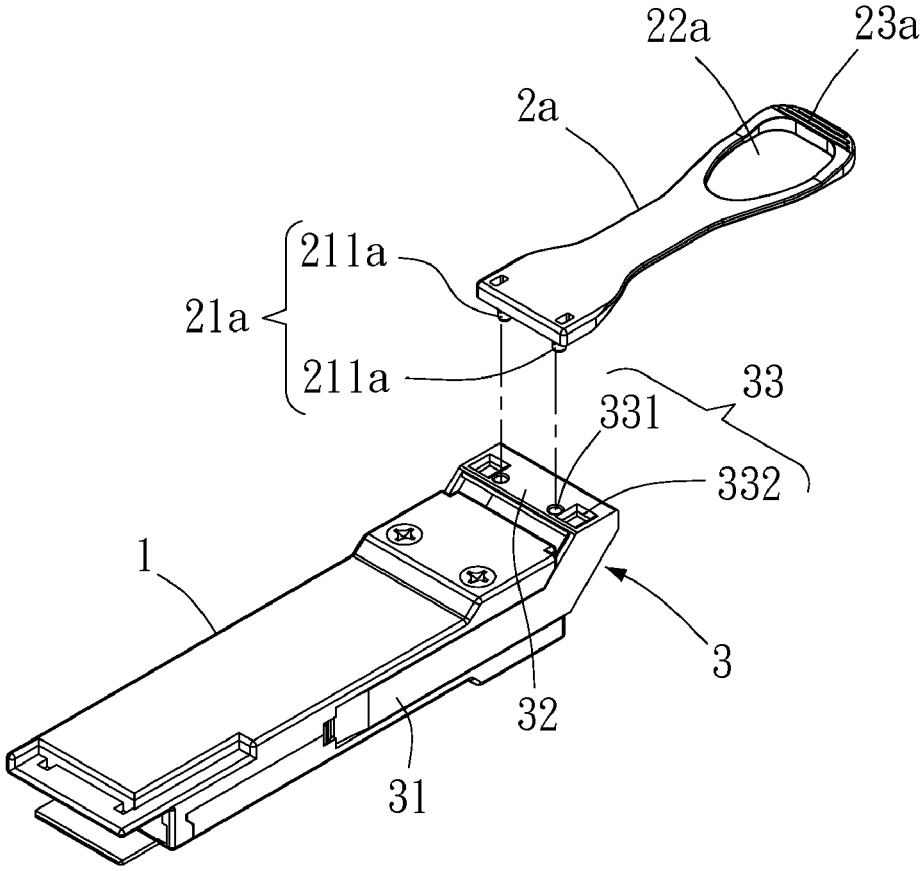
FIG. 5 is an exploded perspective view showing a pull-out structure for connector according to a second embodiment of the present invention.
Figure 6:
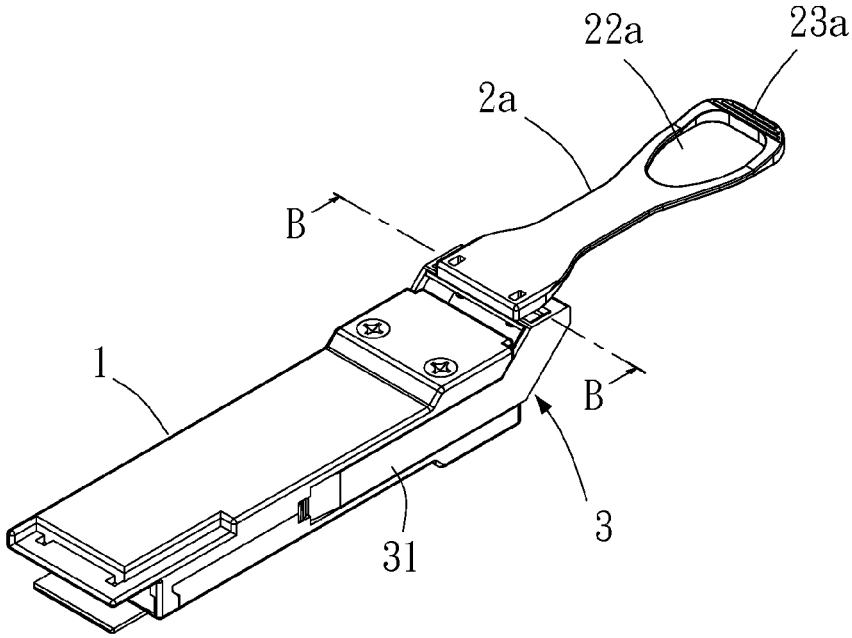
FIG. 6 is an assembled view of FIG. 5.
Figure 7:
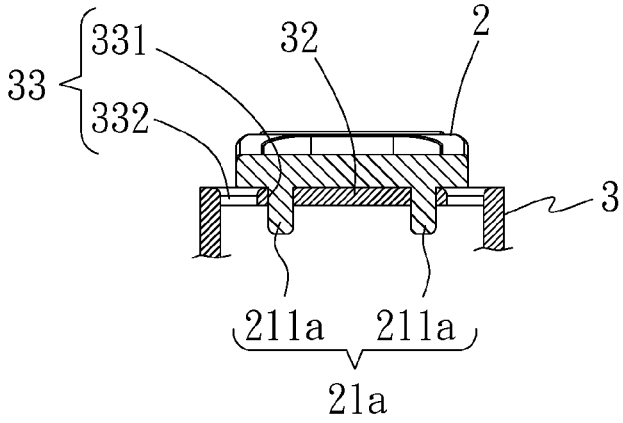
FIG. 7 is a cross-sectional view taken along line B-B of FIG. 6.

Please refer to FIGS. 5 and 6 that are exploded and assembled perspective views, respectively, of a pull-out structure for connector according to a second embodiment of the present invention, and to FIG. 7 that is a cross-sectional view taken along line B-B of FIG. 6. As shown, the pull-out structure for connector in the second embodiment is generally structurally similar to the first embodiment, but includes a pull unit 2*a* having an insertion section 21*a* with at least two corresponding locating pins 211*a*, an opening 22*a*, and an anti-slip area 23*a*.

To assemble the pull unit 2*a* to the rear end of the connector 1, first align the insertion section 21*a* of the pull unit 2*a* with the retaining section 33 of the locking unit 3, and then insert the locating pins 211*a* of the insertion section 21*a* into the through holes 331 of the retaining section 33, so that the pull unit 2*a* is firmly connected to the connector 1 via the locking unit 3. When it is necessary to replace or remove the connector 1 from the shielding cage thereof, the user can extend one finger into the opening 22*a* or pinch the anti-slip area 23*a* on the pull unit 2*a* with thumb and index finger, and apply a rearward pull force on the pull unit 2*a*. At this point, the pull unit 2*a* engaged with the retaining section 33 will bring the transverse plate 32 and accordingly, the sliding arms 31 of the locking unit 3 to move rearward. The rearward moved sliding arms 31 in turn rearward pull the connector 1 out of the shielding cage. Therefore, with the above arrangements, the pull unit 2*a* of the pull-out structure for connector according to the second embodiment of the present invention also has sufficient structural strength to enable easy replacement or removal of the connector 1 from the shielding cage without damaging the connector 1.

Figure 8:
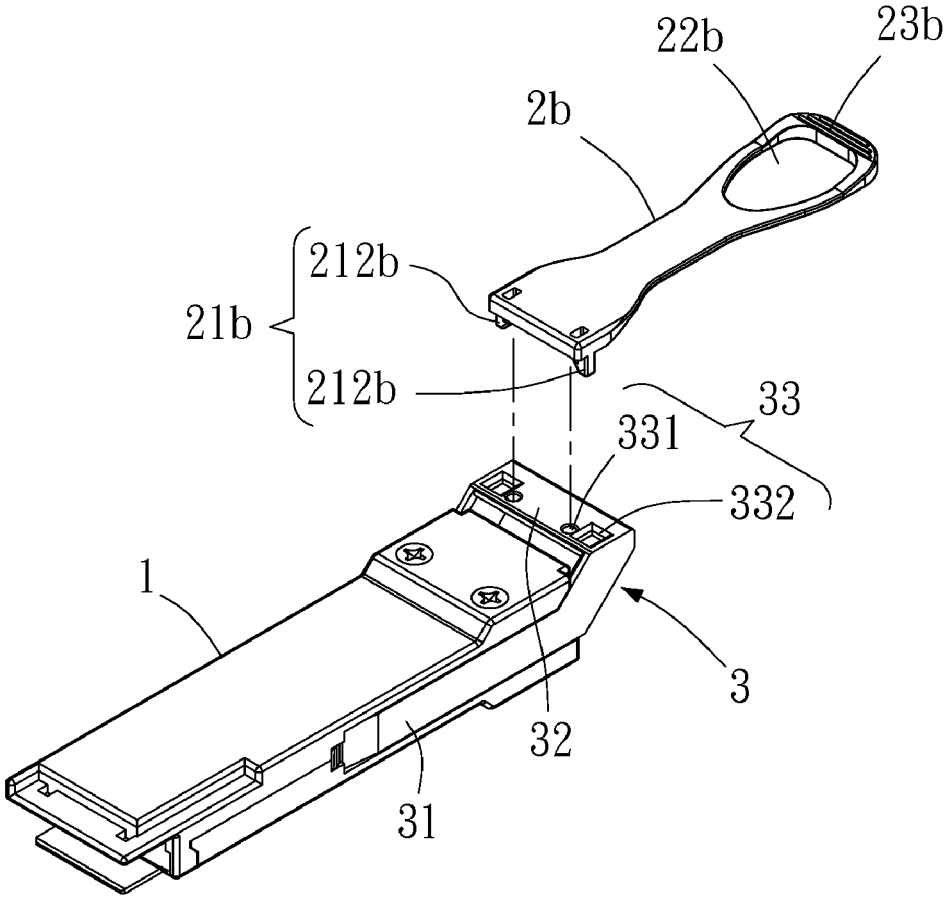
FIG. 8 is an exploded perspective view showing a pull-out structure for connector according to a third embodiment of the present invention.
Figure 9:
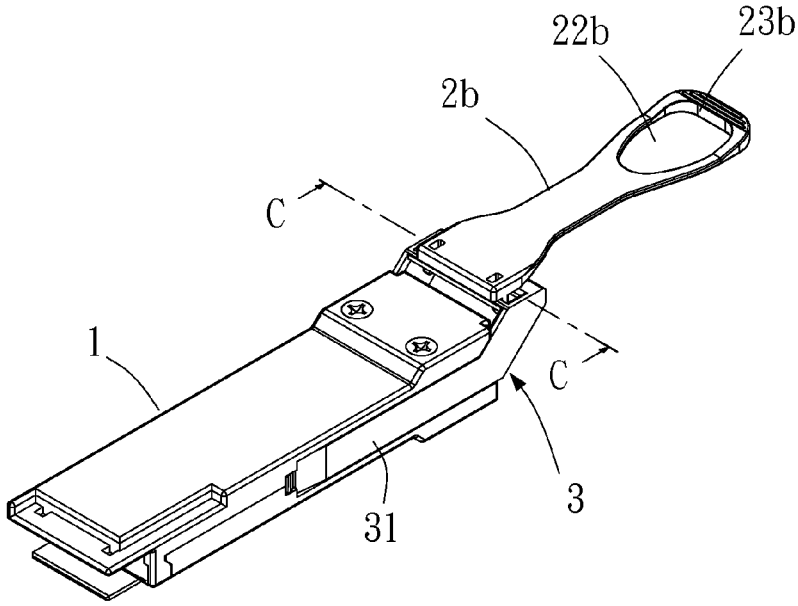
FIG. 9 is an assembled view of FIG. 8.
Figure 10:
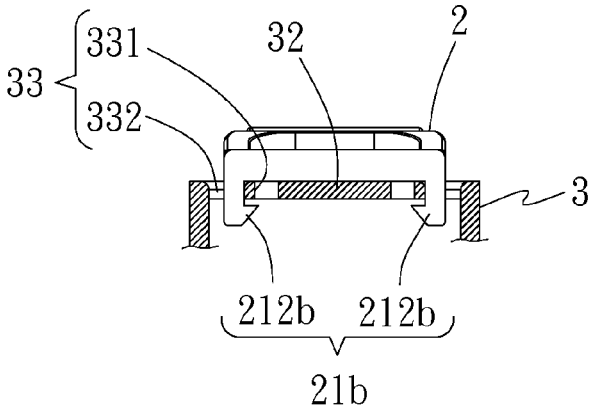
FIG. 10 is a cross-sectional view taken along line C-C of FIG. 9.

Please refer to FIGS. 8 and 9 that are exploded and assembled perspective views, respectively, of a pull-out structure for connector according to a third embodiment of the present invention, and to FIG. 10 that is a cross-sectional view taken along line C-C of FIG. 9. As shown, the pull-out structure for connector in the third embodiment is generally structurally similar to the first and second embodiments, but includes a pull unit 2*b* having an insertion section 21*b* with at least two corresponding hooks 212*b*, an opening 22*b*, and an anti-slip area 23*b*.

To assemble the pull unit 2*b* to the rear end of the connector 1, first align the insertion section 21*b* of the pull unit 2*b* with the retaining section 33 of the locking unit 3, and then insert the hooks 212*b* of the insertion section 21*b* into the receiving holes 332 of the retaining section 33, so that the pull unit 2*b* is firmly connected to the connector 1 via the locking unit 3. When it is necessary to replace or remove the connector 1 from the shielding cage thereof, the user can extend one finger into the opening 22*b* or pinch the anti-slip area 23*b* on the pull unit 2*b* with thumb and index finger, and apply a rearward pull force on the pull unit 2*b*. At this point, the pull unit 2*b* engaged with the retaining section 33 will bring the transverse plate 32 and accordingly, the sliding arms 31 of the locking unit 3 to move rearward. The rearward moved sliding arms 31 in turn rearward pull the connector 1 out of the shielding cage. Therefore, with the above arrangements, the pull unit 2*b* of the pull-out structure for connector according to the third embodiment of the present invention also has sufficient structural strength to enable easy replacement or removal of the connector 1 from the shielding cage without damaging the connector 1.

Figure 11:
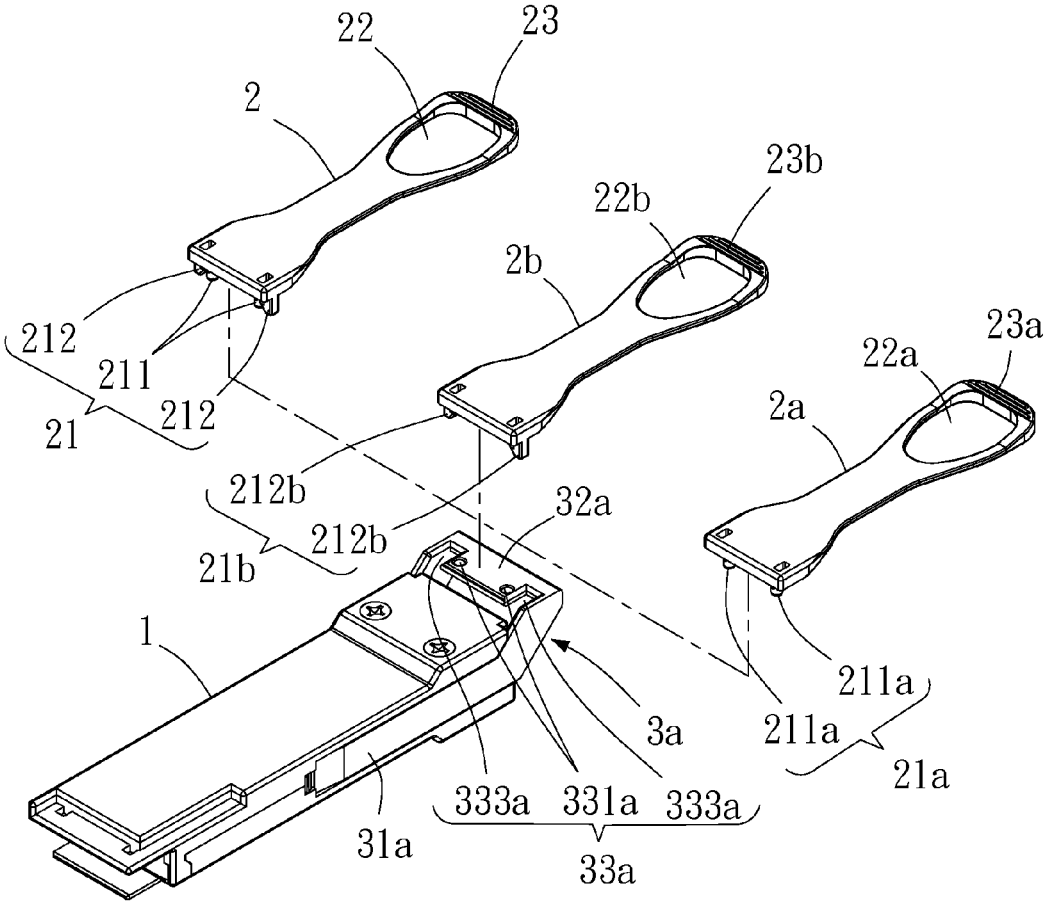
FIG. 11 is an exploded perspective view showing a pull-out structure for connector according to a fourth embodiment of the present invention.

FIG. 11 is an exploded perspective view of a pull-out structure for connector according to a fourth embodiment of the present invention. As shown, the pull-out structure for connector in the fourth embodiment is generally structurally similar to the first, second and third embodiments, but includes a locking unit 3*a* having two sliding arms 31*a*, a transverse plate 32*a* and a retaining section 33*a*. The retaining section 33*a* includes at least two corresponding through holes 331*a* and two forward notches 333*a*; and the two notches 333*a* are separately located at two lateral outer sides of the two through holes 331*a*. Therefore, the retaining section 33*a* of the locking unit 3*a* can be selectively engaged with any one of the insertion sections 21, 21*a* and 21*b* of the pull units 2, 2*a* and 2*b*, respectively. More specifically, with the fourth embodiment of the present invention, the three differently structured pull units 2, 2*a*, 2*b* can be selectively connected to the locking unit 3*a* of the connector 1 in three different manners:

(1) Connecting the pull unit 2 to the locking unit 3*a* by inserting the locating pins 211 and the hooks 212 of the insertion section 21 on the pull unit 2 into the through holes 331*a* and the notches 333*a* of the retaining section 33*a* on the locking unit 3*a*, respectively;

(2) Connecting the pull unit 2*a* to the locking unit 3*a* by inserting the locating pins 211*a* of the insertion section 21*a* on the pull unit 2*a* into the through holes 331*a* of the retaining section 33*a* on the locking unit 3*a*; or (3) Connecting the pull unit 2*b* to the locking unit 3*a* by inserting the hooks 212*b* of the insertion section 21*b* on the pull unit 2*b* into the notches 333*a* of the retaining section 33*a* on the locking unit 3*a*.

When it is necessary to replace or remove the connector 1 from the shielding cage thereof, the user can extend one finger into the opening 22, 22*a*, 22*b* or pinch the anti-slip area 23, 23*a*, 23*b* on the pull unit 2, 2*a*, 2*b* with thumb and index finger, and apply a pull force on the pull unit 2, 2*a*, 2*b*. At this point, the pull unit 2, 2*a*, 2*b* engaged with the retaining section 33*a* will bring the transverse plate 32*a* and accordingly, the sliding arms 31*a* of the locking unit 3*a* to move rearward. The rearward moved sliding arms 31*a* in turn rearward pull the connector 1 out of the shielding cage. Therefore, with the above arrangements, the pull-out structure for connector according to the fourth embodiment of the present invention also has sufficient structural strength to enable easy replacement or removal of the connector 1 from the shielding cage without damaging the connector 1.

Figure 12:
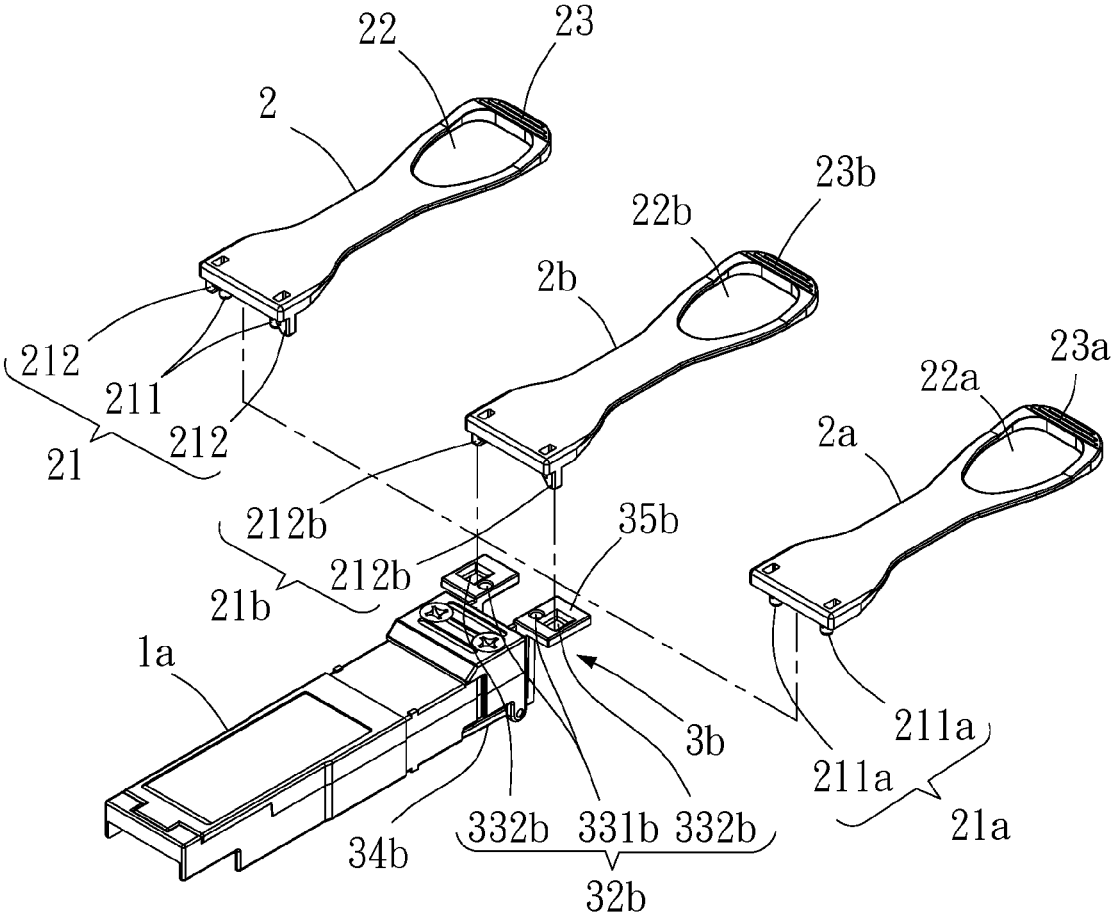
FIG. 12 is an exploded perspective view showing a pull-out structure for connector according to a fifth embodiment of the present invention.

FIG. 12 is an exploded perspective view of a pull-out structure for connector according to a fifth embodiment of the present invention. As shown, the pull-out structure for connector in the fifth embodiment is generally structurally similar to the first, second, third and fourth embodiments, but includes a connector 1*a* and a locking unit 3*b*. The locking unit 3*b* includes a retaining plate 34*b* connected to a bottom of the connector 1*a*; two operating arms 35*b* upward extended from two rear lateral sides of the retaining plate 34*b*; and a retaining section 32*b* provided on top portions of the two operating arms 35*b*. The retaining section 32*b* includes at least two corresponding through holes 331*b* and two receiving holes 332*b*. The two receiving holes 332*b* are separately located at two lateral outer sides of the two through holes 331*b*. Therefore, the retaining section 32*b* of the locking unit 3*b* can be selectively engaged with any one of the insertion sections 21, 21*a* and 21*b* of the pull units 2, 2*a* and 2*b*, respectively. More specifically, with the fifth embodiment of the present invention, the three differently structured pull units 2, 2*a*, 2*b* can be selectively connected to the locking unit 3*b* of the connector 1*a* in three different manners:

(1) Connecting the pull unit 2 to the locking unit 3*b* by inserting the locating pins 211 and the hooks 212 of the insertion section 21 on the pull unit 2 into the through holes 331*b* and the receiving holes 332*b* of the retaining section 32*b* on the locking unit 3*b*, respectively;

(2) Connecting the pull unit 2*a* to the locking unit 3*b* by inserting the locating pins 211*a* of the insertion section 21*a* on the pull unit 2*a* into the through holes 331*b* of the retaining section 32*b* on the locking unit 3*b*; or (3) Connecting the pull unit 2*b* to the locking unit 3*b* by inserting the hooks 212*b* of the insertion section 21*b* on the pull unit 2*b* into the receiving holes 332*b* of the retaining section 32*b* on the locking unit 3*b*.

When it is necessary to replace or remove the connector 1*a* from the shielding cage thereof, the user can extend one finger into the opening 22, 22*a*, 22*b* or pinch the anti-slip area 23, 23*a*, 23*b* on the pull unit 2, 2*a*, 2*b* with thumb and index finger, and apply a pull force on the pull unit 2, 2*a*, 2*b*. At this point, the pull unit 2, 2*a*, 2*b* engaged with the retaining section 32*b* will upward move the retaining plate 34*b* via the operating arms 35*b* and accordingly, cause the locking unit 3*b* to move rearward and pull the connector 1*a* out of the shielding cage. Therefore, with the above arrangements, the pull-out structure for connector according to the fifth embodiment of the present invention also has sufficient structural strength to enable easy replacement or removal of the connector 1*a* from the shielding cage without damaging the connector 1*a*.

Figure 13:
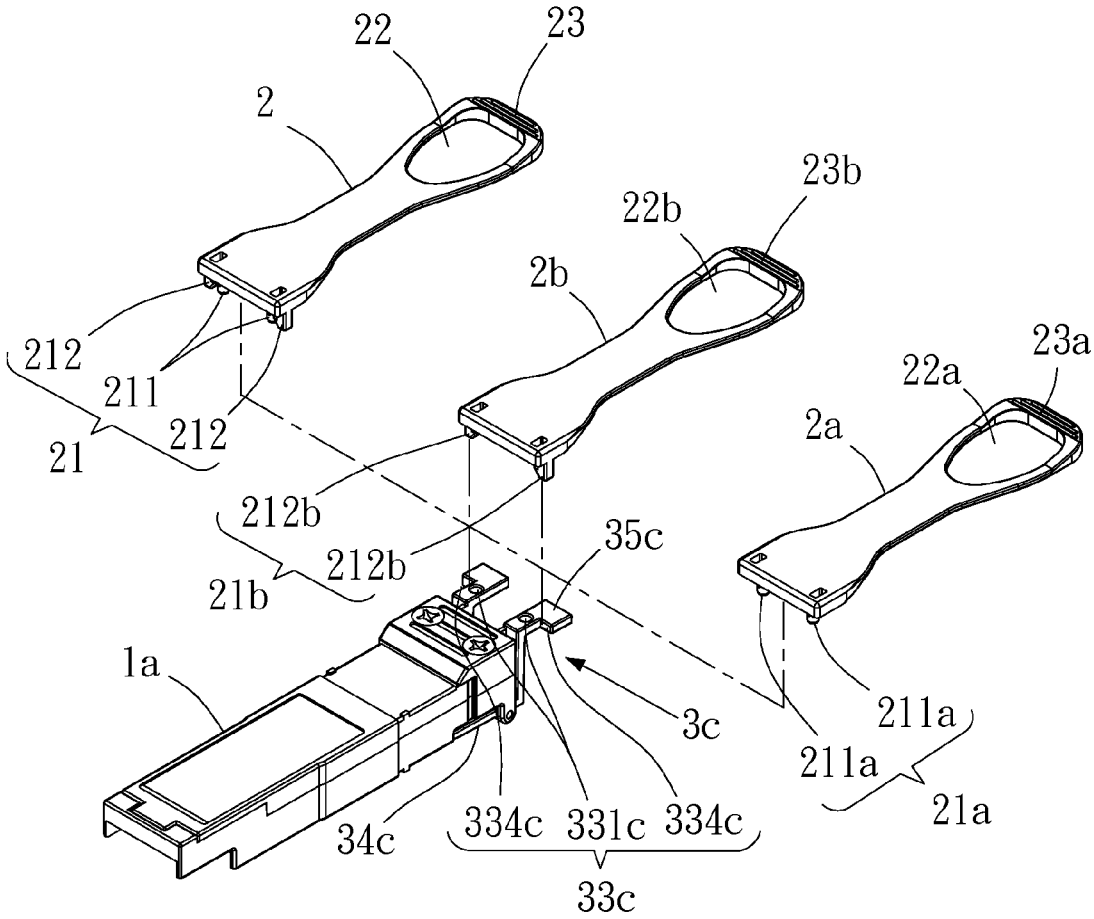
FIG. 13 is an exploded perspective view showing a pull-out structure for connector according to a sixth embodiment of the present invention.

FIG. 13 is an exploded perspective view of a pull-out structure for connector according to a sixth embodiment of the present invention. As shown, the pull-out structure for connector in the sixth embodiment is generally structurally similar to the first, second, third, fourth and fifth embodiments, but includes a connector 1*a* and a locking unit 3*c*. The locking unit 3*c* includes a retaining plate 34*c* connected to a bottom of the connector 1*a*; two operating arms 35*c* upward extended from two rear lateral sides of the retaining plate 34*c*; and a retaining section 33*c* provided on top portions of the two operating arms 35*c*. The retaining section 33*c* includes at least two corresponding through holes 331*c* and two sideward notches 334*c*. The two sideward notches 334*c* are separately located at two lateral outer sides of the two through holes 331*c*. Therefore, the retaining section 33*c* of the locking unit 3*c* can be selectively engaged with any one of the insertion sections 21, 21*a* and 21*b* of the pull units 2, 2*a* and 2*b*, respectively. More specifically, with the sixth embodiment of the present invention, the three differently structured pull units 2, 2*a*, 2*b* can be selectively connected to the locking unit 3*c* of the connector 1*a* in three different manners:

(1) Connecting the pull unit 2 to the locking unit 3*c* by inserting the locating pins 211 and the hooks 212 of the insertion section 21 on the pull unit 2 into the through holes 331*c* and the sideward notches 334*c* of the retaining section 33*c* on the locking unit 3*c*, respectively;

(2) Connecting the pull unit 2*a* to the locking unit 3*c* by inserting the locating pins 211*a* of the insertion section 21*a* on the pull unit 2*a* into the through holes 331*c* of the retaining section 33*c* on the locking unit 3*c*; or (3) Connecting the pull unit 2*b* to the locking unit 3*c* by inserting the hooks 212*b* of the insertion section 21*b* on the pull unit 2*b* into the sideward notches 334*c* of the retaining section 33*c* on the locking unit 3*c*.

When it is necessary to replace or remove the connector 1*a* from the shielding cage thereof, the user can extend one finger into the opening 22, 22*a*, 22*b* or pinch the anti-slip area 23, 23*a*, 23*b* on the pull unit 2, 2*a*, 2*b* with thumb and index finger, and apply a pull force on the pull unit 2, 2*a*, 2*b*. At this point, the pull unit 2, 2*a*, 2*b* engaged with the retaining section 33*c* will upward move the retaining plate 34*c* via the operating arms 35*c* and accordingly, cause the locking unit 3*c* to move rearward and pull the connector 1*a* out of the shielding cage. Therefore, with the above arrangements, the pull-out structure for connector according to the sixth embodiment of the present invention also has sufficient structural strength to enable easy replacement or removal of the connector 1*a* from the shielding cage without damaging the connector 1*a*.

The pull-out structure for connector according to the present invention is novel and improved because, when it is necessary to replace or remove the connector from the shielding cage thereof, the user can directly apply a pull force on the pull unit, which has sufficient structural strength and is engaged with the locking unit on the connector, so that the locking unit is moved rearward to easily pull the connector out of the shielding cage without damaging the connector. The present invention is also industrially useful because products derived from the present invention would no doubt meet the current market demands.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A pull-out structure for connector, comprising:

a connector having a locking unit movably arranged thereon, and the locking unit including a retaining section located at a rear end thereof, wherein the locking unit further includes a pair of sliding arms slidably connected to two lateral sides of the connector, and a transverse plate extended between the two sliding arms, further wherein the retaining section is located on the transverse plate and including at least two corresponding through holes and two forward notches, the two forward notches being separately located at two lateral outer sides of the two through holes; and a pull unit including an insertion section located at a front end thereof, and being engaged with the locking unit by inserting the insertion section into the retaining section of the locking unit, wherein the pull unit is in the form of a flat plate, further wherein the insertion section is located at a lower front end of the pull unit, and includes at least two corresponding locating pins and two hooks separately located at two lateral outer sides of the two locating pins, the locating pins and the hooks are inserted into the through holes and the forward notches, respectively.

2. The pull-out structure for connector as claimed in claim 1, wherein the pull unit is in the form of a flat plate, and the insertion section is located at a lower front end of the pull unit; and wherein the pull unit further includes an opening formed at a rear end thereof.

3. The pull-out structure for connector as claimed in claim 1, wherein the pull unit is in the form of a flat plate, and the insertion section is located at a lower front end of the pull unit; and wherein the pull unit further includes an anti-slip area located on an upper rear end thereof.

4. A pull-out structure for connector, comprising:

a connector having a locking unit movably arranged thereon, and the locking unit including a retaining section located at a rear end thereof wherein the locking unit further includes a retaining plate connected to a bottom of the connector, and two operating arms upward extended from two rear lateral sides of the retaining plate, further wherein the retaining section is located on top portions of the two operating arms and includes at least two corresponding through holes and two sideward notches, the two sideward notches being separately located at two lateral outer sides of the two through holes; and a pull unit including an insertion section located at a front end thereof, and being engaged with the locking unit by inserting the insertion section into the retaining section of the locking unit, wherein the pull unit is in the form of a flat plate, and wherein the insertion section is located at a lower front end of the pull unit, and includes at least two corresponding locating pins and two hooks separately located at two lateral outer sides of the two locating pins, the locating pins and the hooks are inserted into the through holes and the sideward notches, respectively.

5. The pull-out structure for connector as claimed in claim 4, wherein the pull unit is in the form of a flat plate, and the insertion section is located at a lower front end of the pull unit; and wherein the pull unit further includes an opening formed at a rear end thereof.

6. The pull-out structure for connector as claimed in claim 4, wherein the pull unit is in the form of a flat plate, and the insertion section is located at a lower front end of the pull unit; and wherein the pull unit further includes an anti-slip area located on an upper rear end thereof.

* * * * *